US005507047A

United States Patent [19]

Calvert, Jr. et al.

[11] Patent Number: 5,507,047

[45] Date of Patent: Apr. 16, 1996

[54] COMPOSITE MATTRESS ASSEMBLY

[75] Inventors: William A. Calvert, Jr., Dayton, Tenn.; Douglas A. Habegger, Millbury, Ohio

[73] Assignee: La-Z-Boy Chair Company, Monroe, Mich.

[21] Appl. No.: 164,004

[22] Filed: Dec. 8, 1993

[51] Int. Cl.[6] ..... A47C 27/00

[52] U.S. Cl. ..... 5/448; 5/475; 5/250

[58] Field of Search ..... 5/471, 470, 448, 5/475, 465, 478, 499, 250

[56] References Cited

U.S. PATENT DOCUMENTS

| | | | |
|---|---|---|---|
| 1,291,036 | 1/1919 | Linman | 5/499 |
| 2,121,417 | 6/1938 | Wolf | 5/478 |
| 2,217,955 | 10/1940 | Kay . | |
| 2,279,886 | 4/1942 | Fuchs . | |
| 2,425,728 | 8/1947 | Cobb | 5/478 |
| 3,200,418 | 8/1965 | Lebens . | |
| 3,447,170 | 6/1969 | Spitz | 5/465 |
| 3,724,009 | 4/1973 | Ambrose . | |
| 3,950,800 | 4/1976 | Garshfield . | |
| 4,067,076 | 1/1978 | Krier | 5/475 |
| 4,181,990 | 1/1980 | Santo . | |
| 4,231,127 | 11/1980 | Bendell . | |
| 4,336,621 | 6/1982 | Schwartz et al. | 5/465 |
| 4,463,466 | 8/1984 | May et al. | 5/475 |
| 4,782,540 | 11/1988 | Parker . | |
| 5,063,625 | 11/1991 | Perry . | |
| 5,101,527 | 4/1992 | Wadsworth III, et al. . | |
| 5,144,911 | 9/1992 | Moore et al. . | |

FOREIGN PATENT DOCUMENTS

| | | | |
|---|---|---|---|
| 335199 | 3/1989 | European Pat. Off. . | |
| 106181 | 5/1917 | United Kingdom | 5/475 |
| 758078 | 10/1954 | United Kingdom . | |
| 721019 | 12/1954 | United Kingdom . | |
| 1526071 | 9/1978 | United Kingdom . | |
| 2235872A | 3/1991 | United Kingdom . | |

*Primary Examiner*—Michael J. Milano
*Attorney, Agent, or Firm*—Harness, Dickey & Pierce

[57] ABSTRACT

A composite mattress assembly adapted to be extended flat to provide a sleeping surface and to be folded for storage within a sofa is provided. The composite mattress assembly includes a composite pad assembly surrounded by an upper panel and a lower panel. A plurality of linear flange members are fixedly secured to the top edges of the upper panel and are also secured, preferably by staples, at preselected intervals along the lower edges of the composite pad assembly, or along the bottom surface of the composite pad assembly. A plurality of score lines are located upon one or both of an upper pad member and a lower pad member of the spring assembly, to assist in the folding of the composite mattress assembly, while maintaining fixed relative positions of all components, thereby reducing bunching and relative shifting of mattress materials and components during folding.

26 Claims, 3 Drawing Sheets

FIG 1
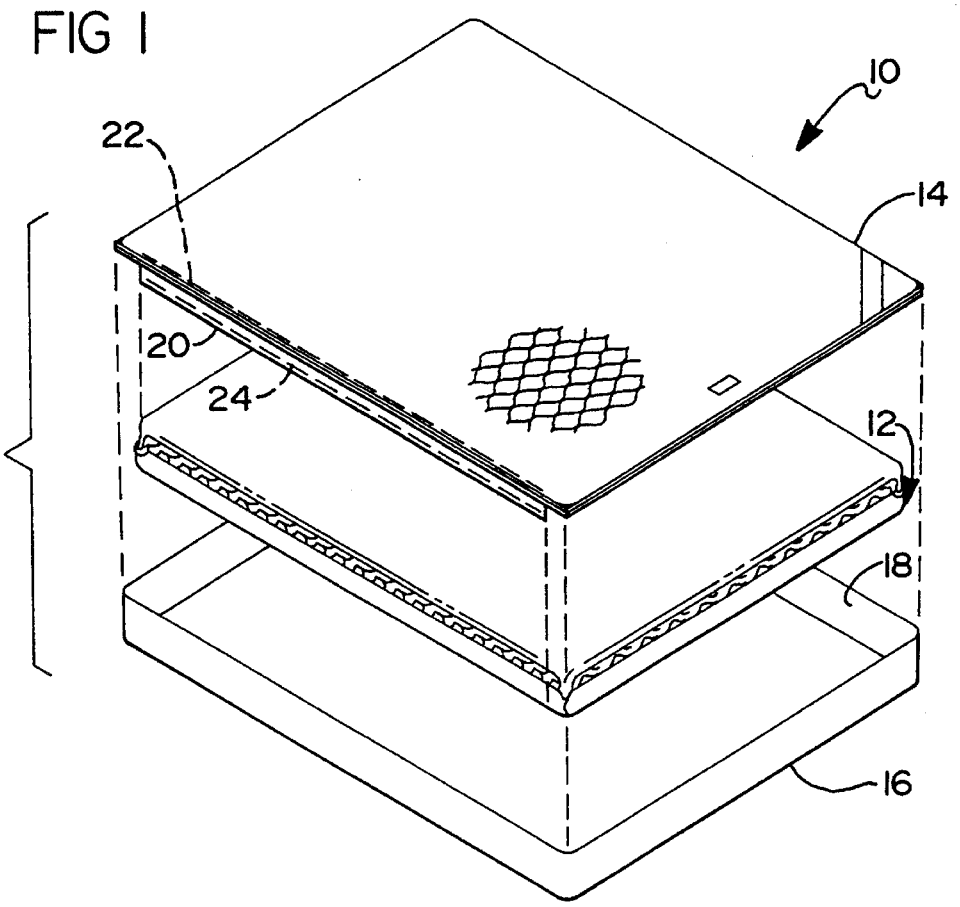
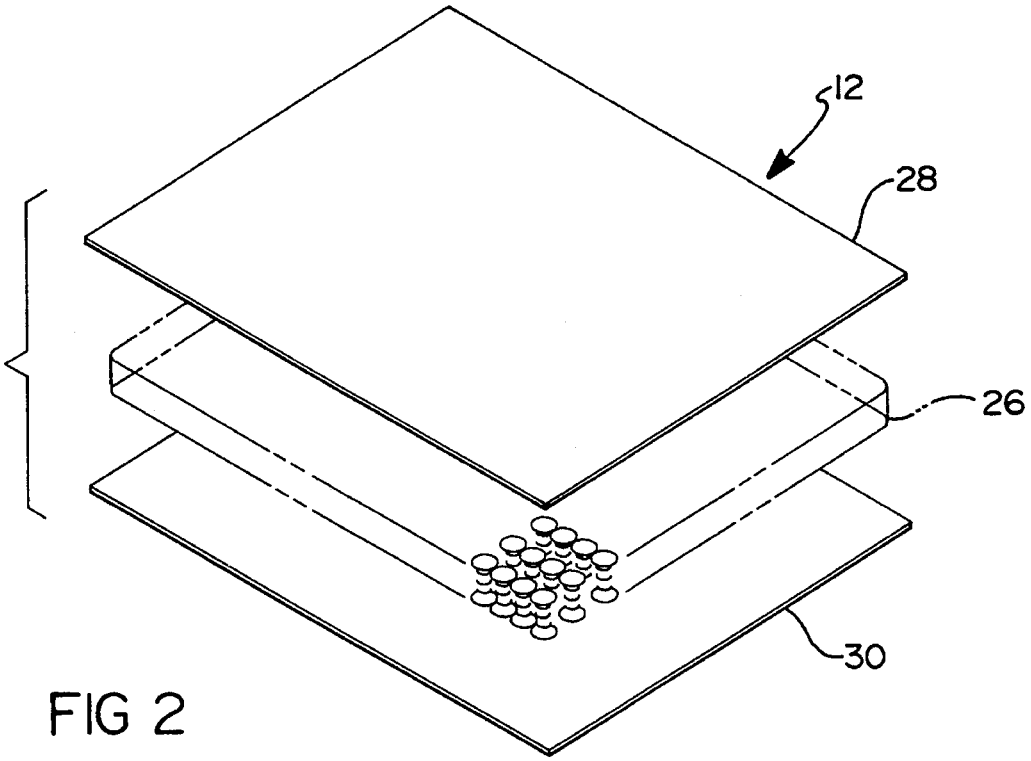
FIG 2

COMPOSITE MATTRESS ASSEMBLY

BACKGROUND OF THE INVENTION

1. Technical Field

The present invention relates generally to mattresses, and more particularly to sleeper sofa mattresses of the type having a spring assembly and an overlying top cushion.

2. Discussion

Sleeper sofa mattresses are designed to be extended flat to provide a sleeping surface and to be folded for storage within a sofa. Folding of the mattress for storage generally involves doubling over one or more parts of the mattress, thereby providing a substantially flat surface for the placement of sofa seat cushions thereupon. This folding of the mattress is often accompanied by a bunching of the padding assembly, including bunching of the covering and/or additional padding located within the padding assembly. This bunching typically takes place across several random and irregular transverse flexure lines which are created because of the inability of multiple layers of padding and covering materials to be fixedly secured to each other at incremental locations along the length and width of the mattress. Bunching may also occur where the mattress covering and/or padding members may become retained within the folds of a spring assembly, causing an inability to completely compress the folds.

Bunching of the mattress covering and/or padding members may result in increased difficulty in folding the mattress, and may also result in a tendency for the mattress to retain a portion of the folded shape when extended flat. This is due at least in part to the shifting of the padding and covering materials relative to each other in a lengthwise direction along the mattress. This bunching and shifting may additionally reduce the sofa's seating comfort, and, over time, a deterioration in the condition of the mattress at or around the folding locations may shorten the useful life of the mattress.

The need therefore exists for an improved method for securing multiple layers of a composite mattress assembly in a fixed relative relation at incremental locations along the length of the mattress assembly so that a folding of the mattress may be conveniently accomplished without bunching and shifting of the mattress components. The need also exists to reduce the tendency of the mattress to retain a portion of its folded shape when extended flat.

SUMMARY OF THE INVENTION

In accordance with the teachings of a preferred embodiment of the present invention, a composite mattress assembly is provided. The composite mattress assembly of the present invention utilizes a composite pad assembly having a plurality of transverse score lines located thereupon. An upper panel, which may be in the form of a top quilted pad, is operable to be disposed upon the top surface of the composite pad assembly. The composite mattress assembly further includes a plurality of flange members fixedly disposed in communication with the upper panel and the composite pad assembly. Preferably, the plurality of flange members are provided as two flange members disposed substantially along both longitudinal edges of the upper panel and the composite pad assembly. The flange members are secured in a substantially fixed relation between the upper panel and the composite pad assembly by being sewn to the edges of the upper panel and by being stapled at preselected intervals to lower portions of the sides of the composite pad assembly, or to the bottom of the composite pad assembly.

BRIEF DESCRIPTION OF THE DRAWINGS

The various features and advantages of the present invention will become apparent to one skilled in the art upon reading the following description of the preferred embodiment in which:

FIG. 1 is an exploded perspective view illustrating the components of the composite mattress assembly of the present invention;

FIG. 2 is an exploded partial cut-away view illustrating a composite pad and spring assembly of the present invention;

DETAILED DESCRIPTION OF THE PREFERRED EMBODIMENT

Figure 3:
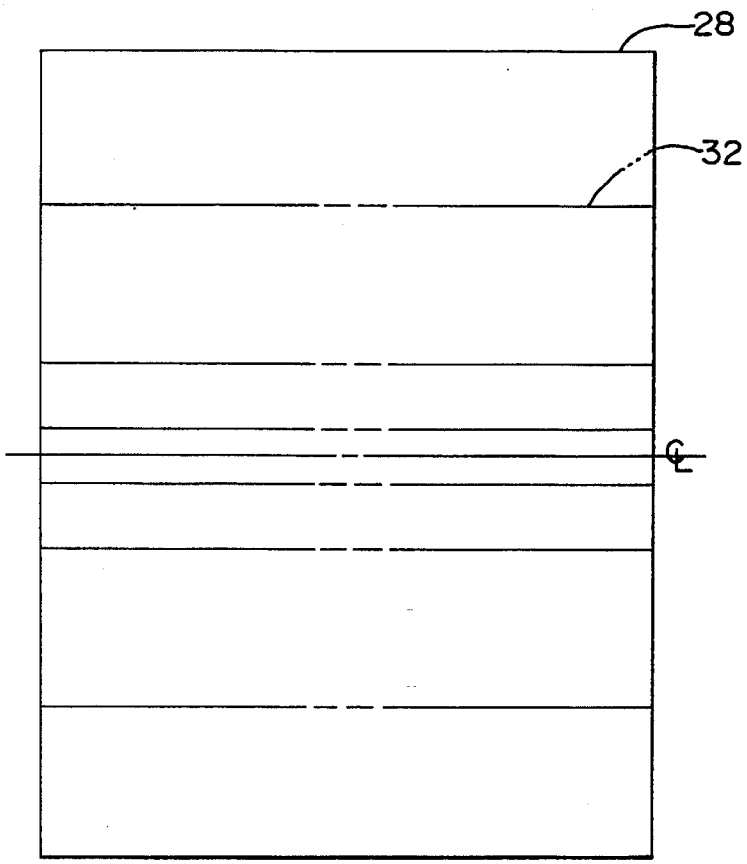
FIG. 3 is a top view illustrating a pad member of the present invention.

It should be understood from the outset that while the drawings and following discussion relate to a particular embodiment of the present invention, this embodiment merely represents what is presently regarded as the best mode of practicing the invention and other modifications may be made to the particular embodiment without departing from the spirit and scope of the invention.

The preferred embodiment of the present invention will now be described with reference to FIGS. 1–5. More particularly, FIG. 1 illustrates an exploded perspective view of a composite mattress assembly, shown generally at 10. The composite mattress assembly 10 includes a composite pad and spring assembly 12. The composite mattress assembly 10 also includes an upper panel 14, which is preferably a top quilted pad of the type well known to both those skilled in the art and to the consuming public. The composite mattress assembly 10 may also include a lower panel 16, which may take the form of a fabric box. When in the form of a fabric box, the lower panel 16 will typically include four sides 18 which form the sides of the composite mattress assembly 10 when all components are assembled together. As such, the composite pad and spring assembly 12 is sized so as to fit within the sides 18 of the fabric box, or lower panel 16. The upper panel 14, or top quilted pad, substantially covers the composite pad and spring assembly 12, and is secured at its edges to the lower panel 16 along the top edges of the sides 18.

In order to maintain a substantially secured relation between the composite pad and spring assembly 12 and the upper panel 14 at incremental locations along the length of the composite pad and spring assembly 12 and the upper panel 14, a plurality of flange members 20 are provided. The flange members 20 are preferably provided as two disconnected members disposed along the two lengthwise or longitudinal edges of the upper panel 14. The flange members 20 are preferably fixedly secured to the edges of the upper panel 14 by being sewn along sew lines 22 by suitable techniques well known to those skilled in the art. The flange members 20 are preferably sized to be disposed along a substantial portion of each side of the upper panel 14, while not being disposed at the corners of the upper panel 14, as shown in FIG. 1. The flange members 20 are preferably of a height sufficient so that the flange members 20 may extend substantially to the bottom of each side of the composite pad and spring assembly 12, or alternatively so the flange members 20 may extend around the lower edges of the composite pad and spring assembly 12 to the bottom or lower surface of the composite pad and spring assembly 12. The flange members 20 are fixedly secured to either the lower region of the sides of the composite pad and spring assembly 12, or alternatively to the bottom surface of the composite pad and spring assembly 12. In a preferred embodiment, the flange members 20 are secured to the composite pad and spring assembly 12 through the use of a plurality of staples 24 disposed at fixed intervals along the length of the two flange members 20. Preferably, the preselected interval for locating the staples 24 is approximately six inches. It will be appreciated, however, that other preselected intervals may be used.

Referring now to FIG. 2, there is illustrated an exploded partial cross-sectional view of a composite pad and spring assembly, shown generally at 12. The composite pad and spring assembly 12 includes a spring assembly 26, which may be in the form of a conventional multiple coil assembly well known to those skilled in the art. The spring assembly 26 is of a type suitable for use with sleeper sofas, in that the spring assembly 26 may be folded and unfolded repeatedly without damage. The composite pad and spring assembly 12 is further shown to include an upper pad member 28 on its upper surface and a lower pad member 30 on its lower surface, which may be of substantially the same construction. The upper pad member 28 and/or the lower pad member 30 may substantially enshroud the spring assembly 26 by being folded upon at least portions of the sides of the spring assembly 26, and may preferably be joined at the corners, or at other locations. As such, the folding of a portion of the upper pad member 28 and/or the lower pad member 30 around the sides of the spring assembly 26 may allow the flange members 20 to be preferably secured to the lower pad member 30 either along the lower side regions of the composite pad and spring assembly 12 or along its bottom surface.

Preferably, both the upper pad member 28 and the lower pad member 30 are each constructed as a shoddy pad of shredded man-made fabric clippings without loose fibers whose shape and arrangement is substantially maintained by a resin binder coating uniformly covering both surfaces of each shoddy pad. This arrangement is advantageous because it allows folding of the padding material while reducing bunching and shifting of the material. Alternatively, other suitable padding materials may be used. The padding material is typically enshrouded by a covering fabric material to form each pad member.

Referring now to FIG. 3, there is illustrated a top view of a pad member of the present invention. In FIG. 3, the pad member is illustrated as an upper pad member 28, although it will be appreciated that the lower pad member 30 may be of substantially the same construction. The upper pad member 28 is shown to include a plurality of transverse score lines 32. The transverse score lines 32 are preferably a series of slight indentations made by the force exerted upon the upper pad member 28 by a plurality of blunted blades mounted to the same roller which supports the blades that cut the pad material into suitable sized sections to form individual pad members from a continuous pad material roll during manufacture.

Figure 4:
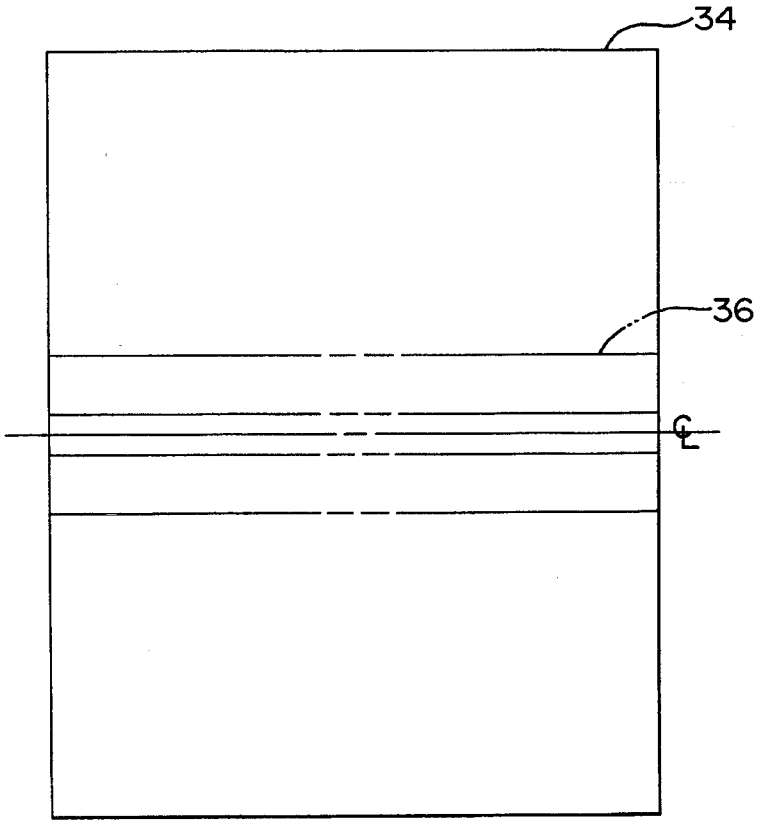
FIG. 4 is a top view illustrating an alternate embodiment of a pad member of the present invention.

The score lines 32 are preferably disposed in a transverse or crosswise direction upon one or both of the upper pad member 28 and the lower pad member 30 to assist the upper pad member 28 and/or the lower pad member 30 in folding, thereby assisting the composite mattress assembly 10 in folding as a whole, as will be discussed below. Referring now to FIG. 4, there is illustrated a top view of an alternate embodiment of the pad member of the present invention. As before, the pad member is illustrated as an upper pad member 34, although it will be appreciated that the lower pad member may be of substantially the same construction. The upper pad member 34 is shown to include a plurality of transverse score lines 36. The transverse score lines 36 are substantially the same as those previously discussed, but are fewer in number in this version of the mattress pad member. It will be appreciated that the score lines 32 and 36 may be disposed singularly at each desired fold point of the composite mattress assembly 10, or may preferably be disposed in a multiple neighboring configuration so that multiple score lines may interact with each other upon folding, thereby providing a cumulative beneficial effect. At the time the transverse score lines 32 and 36 are made, the continuous pad material is still warm from the manufacturing process. While the resultant transverse score lines 32 and 36 are only slightly noticeable visually or by touch, they are nevertheless sufficient for the pad member to retain "memory" locations for folding.

Figure 5:
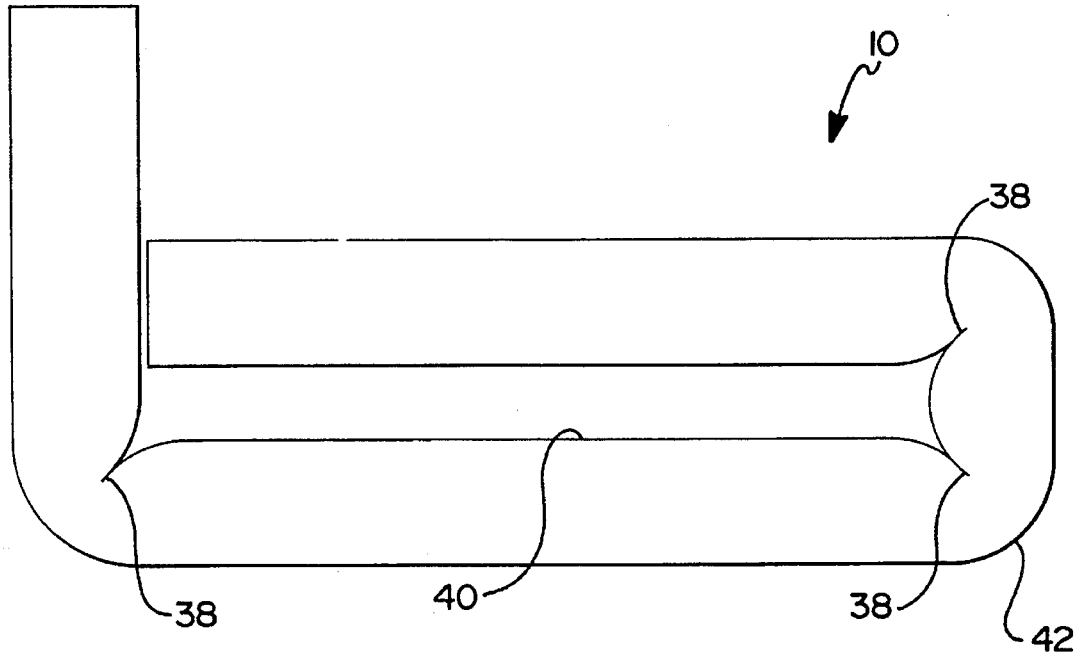
FIG. 5 is a side view illustrating a folded composite mattress assembly of the present invention.

Referring now to FIG. 5, there is illustrated a composite mattress assembly 10, in a folded condition. When it is desired to fold the composite mattress assembly 10, such as for storage within a sleeper sofa, it is bent at predetermined locations for folding by the sleep sofa mattress supporting mechanism (not shown). The folding pressure at or near the locations of the transverse score lines 32 causes the composite pad and spring assembly 12 disposed therewithin to crease laterally and overlap itself. Because the sides of the composite mattress assembly 10 are in a substantially secured relation as previously stated, a fold point 38 is created at this location on what becomes the interior fold surface 40 of the composite mattress assembly 10 following a bending of the mattress. Multiple folds of the composite mattress assembly 10 may similarly cause the formation of multiple fold points 38 along the length of the mattress. The exterior fold surface 42 is simply allowed to bend in a natural arcuate manner in response to the folding action.

It should be noted that the locations of the transverse score lines 32 and 36 upon the upper pad members 28 and 34, which preferably correspond to locations upon the lower pad members, such as 30, may preferably be substantially symmetrical with respect to the centerline C. Thus, in situations where the construction of the spring assembly 26 permits, the composite mattress assembly 10 may be rotated 180° in a head-to-toe direction, so as to allow reversibility of the mattress.

Thus, as previously described, the combination of incomplete flange members 20 disposed in a substantially secured relation at preselected intervals along the longitudinal edges of the composite mattress assembly 10 with the plurality of score lines 32 across one or both pad members of the composite pad and spring assembly 12 results in improved folding of the composite mattress assembly 10. This combination serves to reduce bunching of the materials of the upper panel 14 and/or the other components of the composite mattress assembly 10, while also preventing shifting of these materials and components relative to each other. This improvement in folding is accompanied by an improvement in flat extension of the composite mattress assembly 10 upon unfolding and increased wearability and thus longevity of the mattress assembly itself.

While the above detailed description describes a preferred embodiment of the present invention, it will be understood that the description is exemplary in nature and is not intended to limit the scope of the invention. The present invention will therefore be understood as susceptible to modification, alteration and variation by those skilled in the art without deviating from the scope and meaning of the following claims.

What is claimed is:

1. A composite mattress assembly adapted to be extended flat to provide a sleeping surface and to be folded for storage within a sofa, said composite mattress assembly comprising:

a composite pad assembly having at least one pad member, each pad member being formed in at least one layer, each layer being planar with respect to each other layer, each layer being formed with a plurality of transverse score lines thereupon and independently operable to fold at said transverse score lines;

an upper panel operable to be disposed upon said composite pad assembly; and a plurality of linear flange members fixedly disposed in communication with said upper panel and said composite pad assembly.

2. The composite mattress assembly according to claim 1, wherein each of said composite pad assembly and said upper panel include two longitudinal edges, and wherein said plurality of flange members comprises two flange members, each flange member fixedly disposed along a longitudinal edge of said upper panel and said composite pad assembly.

3. The composite mattress assembly according to claim 2, wherein said flange members are sewn to said upper panel and stapled to said composite pad assembly at a preselected interval.

4. The composite mattress assembly according to claim 3, wherein said preselected interval is six inches.

5. The composite mattress assembly according to claim 1, wherein said composite pad assembly comprises:

a spring assembly having an upper surface and a lower surface; and an upper pad member disposed upon said upper surface of said spring assembly, said upper pad member having a plurality of transverse score lines located thereupon.

6. The composite mattress assembly according to claim 5, wherein said upper panel includes two longitudinal edges, and wherein said plurality of flange members comprises two flange members, each flange member fixedly disposed lengthwise along a longitudinal edge of said upper panel and said lower surface of said spring assembly.

7. The composite mattress assembly according to claim 6, wherein said flange members are sewn to said upper panel and stapled at a preselected interval to a lower pad member that is disposed upon said lower surface of said spring assembly.

8. The composite mattress assembly according to claim 7, wherein said preselected interval is six inches.

9. The composite mattress assembly according to claim 5, wherein said upper panel includes two longitudinal edges, and wherein said plurality of flange members comprises two flange members, each flange member fixedly disposed lengthwise along a longitudinal edge of said upper panel and a side of said spring assembly.

10. The composite mattress assembly according to claim 9, wherein said flange members are sewn to said upper panel and stapled at a preselected interval to a lower pad member that is disposed upon two sides of said spring assembly.

11. The composite mattress assembly according to claim 10, wherein said preselected interval is six inches.

12. The composite mattress assembly according to claim 1, wherein said upper panel is a top quilted pad.

13. The composite mattress assembly according to claim 1 further comprising a lower panel operable to be disposed upon said composite pad assembly.

14. The composite mattress assembly according to claim 13, wherein said lower panel is a fabric box.

15. The composite mattress assembly according to claim 5, wherein said upper pad member includes a shoddy pad of shredded man-made fabric clippings covered by a resin binder coating.

16. A composite mattress assembly adapted to be extended flat to provide a sleeping surface and to be folded for storage within a sofa, said composite mattress assembly comprising:

a spring assembly having an upper surface and a lower surface;

an upper pad member disposed upon said upper surface of said spring assembly, said upper pad member being formed in at least one layer, each layer being planar with respect to each other layer, each layer being formed with a plurality of transverse score lines thereupon and independently operable to fold at said transverse score lines;

a lower pad member disposed upon at least said lower surface of said spring assembly, said lower pad member being formed in at least one layer, each layer being formed with a plurality of transverse score lines thereupon and independently operable to fold at said transverse score lines;

an upper panel including two longitudinal edges; and a plurality of linear flange members disposed in fixed communication with said upper panel and said lower pad member.

17. The composite mattress assembly according to claim 16, wherein said plurality of linear flange members comprises two flange members, each flange member fixedly disposed lengthwise along a longitudinal edge of said upper panel and said lower pad member.

18. The composite mattress assembly according to claim 17, wherein said flange members are sewn lengthwise to said upper panel and stapled lengthwise to said lower pad member at a preselected interval.

19. The composite mattress assembly according to claim 18, wherein said preselected interval is six inches.

20. The composite mattress assembly according to claim 16, wherein said upper panel is a top quilted pad.

21. The composite mattress assembly according to claim 16 further comprising a lower panel operable to be disposed upon said lower pad member.

22. The composite mattress assembly according to claim 21, wherein said lower panel is a fabric box.

23. A composite mattress assembly adapted to be extended flat to provide a sleeping surface and to be folded for storage within a sofa, said composite mattress assembly comprising:

a spring assembly having an upper surface and a lower surface;

an upper pad member disposed upon said upper surface of said spring assembly, said upper pad member having a plurality of transverse score lines located thereupon;

a lower pad member disposed upon said lower surface of said spring assembly, said lower pad member having a plurality of transverse score lines located thereupon;

a top quilted panel including four edges substantially defining a perimeter thereof; and two linear flange members, each flange member fixedly disposed lengthwise along a longitudinal edge of said top quilted panel and said lower pad member, each flange member sewn lengthwise to said top panel and stapled lengthwise to said lower pad member at six-inch intervals.

24. The composite mattress assembly according to claim 23, wherein said plurality of transverse score lines comprises two transverse score lines.

25. The composite mattress assembly according to claim 23, wherein said plurality of transverse score lines comprises four transverse score lines.

26. The composite mattress assembly according to claim 23, wherein said plurality of transverse score lines comprises six transverse score lines.

* * * * *